United States Patent [19]

Godfrey et al.

[11] Patent Number: 4,921,438

[45] Date of Patent: May 1, 1990

[54] WET CONNECTOR

[75] Inventors: Craig W. Godfrey, Richardson; Mark A. Schnatzmeyer, Lewisville; Henry P. Arendt, Dallas, all of Tex.

[73] Assignee: Otis Engineering Corporation, Dallas, Tex.

[21] Appl. No.: 340,450

[22] Filed: Apr. 17, 1989

[51] Int. Cl.[5] ..... E21B 23/02

[52] U.S. Cl. ..... 439/190; 166/65.1; 439/332

[58] Field of Search ..... 439/140, 190–195, 439/196, 198, 199, 201, 205, 332–335; 166/65.1, 66, 66.4

[56] References Cited

U.S. PATENT DOCUMENTS

| | | | |
|---|---|---|---|
| 2,620,029 | 12/1952 | Turechek | 166/65.1 |
| 4,031,969 | 6/1977 | Cullen et al. | 166/66.4 |
| 4,105,279 | 8/1978 | Glotin et al. | 439/201 |
| 4,188,084 | 2/1980 | Buresi et al. | 439/577 |
| 4,266,613 | 5/1981 | Boop | 166/65.1 |
| 4,442,893 | 4/1984 | Foust | 166/117.5 |
| 4,500,156 | 2/1985 | Nguyen | 439/190 |
| 4,510,797 | 4/1985 | Guidry et al. | 439/190 |
| 4,553,428 | 11/1985 | Upchurch | 73/152 |
| 4,583,592 | 4/1986 | Gazda et al. | 166/250 |
| 4,589,717 | 5/1986 | Pottier et al. | 439/190 |
| 4,624,309 | 11/1986 | Schnatzmeyer | 439/191 |
| 4,757,859 | 7/1988 | Schmatzmeyer | 166/117.5 |
| 4,767,349 | 8/1988 | Pottier et al. | 439/191 |
| 4,781,607 | 11/1988 | Rumbaugh | 439/191 |

OTHER PUBLICATIONS

World Oil, Composite Catalog of Oil Field Equipment, 1982–1983 Edition, pp. 3180–3187.

World Oil, Composite Catalog, 1988–89 Edition, pp. 3340–3346 to 3340–3417.

World Oil, Composite Catalog, 1986–87 Edition, pp. 2054–2060.

*Primary Examiner*—Neil Abrams

*Attorney, Agent, or Firm*—Albert W. Carroll

[57] ABSTRACT

A wet connector for latchingly connecting an electric cable between surface equipment and a previously installed electrically powered well tool at a remote, downhole location in a well for transmitting electrical energy or signals thereto or therefrom. One form of the wet connector is released electricaly (reverse polarity being used), and another form of the connector is released by tensioning and slackening the electric cable a predetermined plurality of times. Systems using such wet connectors are disclosed, as are methods for their use. The wet connector can be used in conjunction with an electric cable for installing certain tools in a well, especially where it is desirable to deposit such tools gently with no jarring.

20 Claims, 5 Drawing Sheets

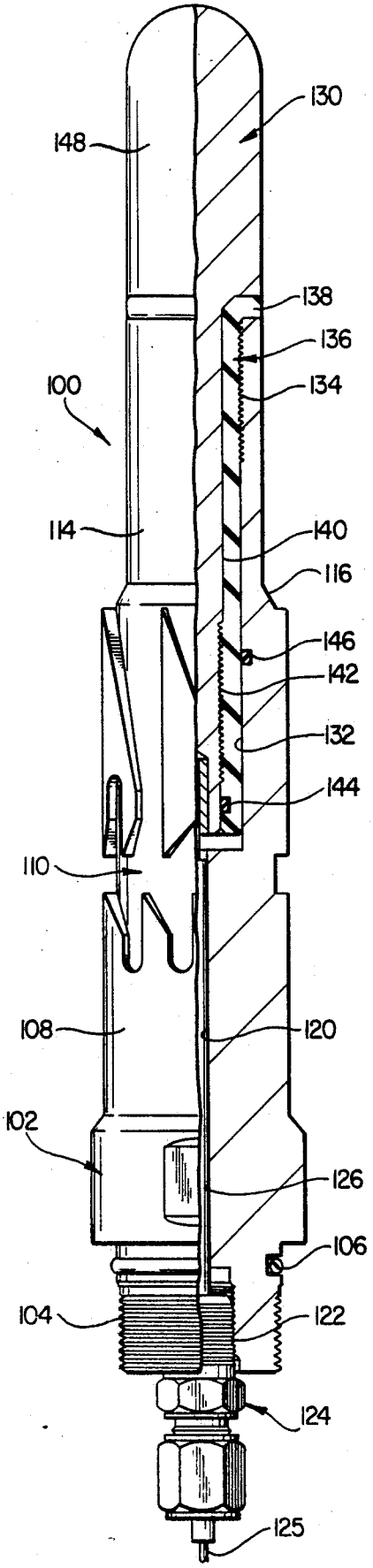
FIG. 2
FIG. 3
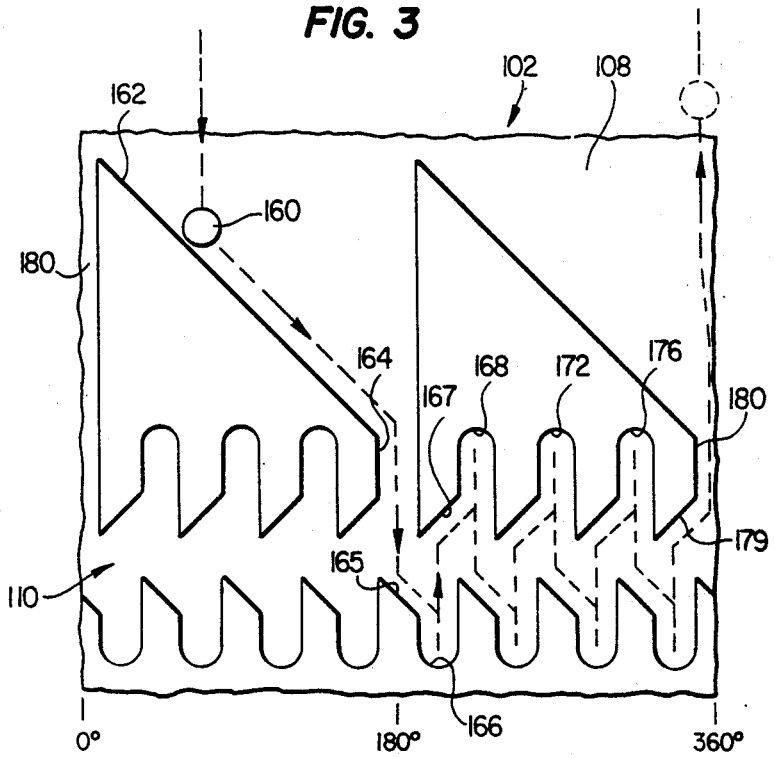

WET CONNECTOR

BACKGROUND OF THE INVENTION

1. Field of the Invention

This invention relates to well tools, and more particularly to electrical connectors for connecting electrical cables to electrically powered tools even when submerged in electrically conductive liquids.

2. Description of Related Art

For several years, wet connectors have been known for making electrical connections under water or in similar hostile environments in order to supply power to electrically operated devices, or to obtain data gathered by downhole instruments such as transducers for sensing pressures or temperatures. Some such wet connectors are for use in wells, such as oil and gas wells, where conductive liquids, such as salt water or water laden with conductive substances, are usually present.

Applicants are familiar with the following prior U.S. Pat. Nos. which are believed to be pertinent to the invention claimed in the present application for Pat. Nos.:

3,939,705, 4,500,156, 4,583,592, 4,105,279, 4,510,797, 4,624,309, 4,757,859, 4,442,893, 4,553,428, 4,589,717, 4,767,349,

U.S. Pat. No. 3,393,705, issued to Bernard J.P. Glotin, et al., on Feb. 24, 1976 and, a division thereof, U.S. Pat. No. 4,105,279 issued to the same inventive entity on Aug. 8, 1978, disclose a side pocket mandrel having a male electrical connector projecting upwardly from the bottom of the offset landing receptacle. This male connector has its lower end projecting through the wall of the mandrel where it is connected to an electrical conductor running upward alongside the tubing to the surface. An electrically powered measuring instrument having a wet connector on its lower end and a latch on its upper end is installable in the offset receptacle with its wet commentor engaged with the male connector and its latch engaged in the latch recess at the upper end of the receptacle. The wet connector may contain an insulating fluid such as liquid silicone. The electric cable serves to supply power to the instrument from the surface and to transmit data from the instrument to the surface.

U.S. Pat. No. 4,510,797 which issued to Shelby L. Guidry, et al., on Apr. 16, 1985 teaches use of a full-bore drill stem test tool having one or more recording gauges for storing data gathered by one or more transducers which may sense pressures and temperatures above a downhole valve. The test tool includes a section having electrical contact pins which are located at the upper end of internal longitudinal grooves. Orienting guides are associated with the grooves while an abrupt upwardly facing shoulder is provided a short distance below the grooves. A contact tool lowerable into the well on an electric cable has means for engaging the abrupt shoulder and when weight is set down, contact arms pivot from a retracted position to a position in which they extend outwardly and upwardly. As this contact tool is subsequently lifted the contact arms are directed by the guides into the grooves. The outer ends of the contact arms travel upward in the grooves and make electrical contact with the downwardly extending contact pins. Thus engaged, data stored in the recording gauges can be transmitted to the surface for read out and the data sensed by the gauges can be displayed at the surface as they are gathered so long as the electric cable remains tensioned sufficient to maintain the electrical connection between the contact arms and the contact pins. Lowering the contact arms only a very short distance will break the electrical continuity. Setting down weight causes the contact arms to be retracted so that the tool can be lifted back to the surface.

U.S. Pat. No. 4,553,428 issued to James M. Upchurch on Nov. 19, 1985. This patent discloses use of drill stem test equipment which utilizes the invention of Guidry, et al., No. 4,510,797 in such way that pressures below or above the test valve and pressures in the annulus exterior of the test tool are sensed. A contact tool can be run into the well as taught by Guidry, et al. to transmit the recorded data to the surface and/or for transmitting such data as they are sensed, these data in either case being handled by surface readout equipment.

U.S. Pat. No. 4,589,717 which issued to Alain P. Pottier, et al. on May 20, 1986 teaches a wet connector wherein the male connector is lowered into a well and is engaged with a female connector. The female connector contains a dielectric liquid and is meant to operate more than just once. The wet connector has several contact members on each of the male and female portions and is intended for use with a well logging tool.

U.S. Pat. No. 4,624,309 issued to Mark A. Schnatzmeyer on Nov. 25, 1986 and discloses an improvement over the inventions of Glotin, et al. of Pat. Nos. 3,939,705 and 4,105,279. Pat. No. 4,624,309 teaches use of a side pocket mandrel having a longitudinal groove extending from the upper end of the offset receptacle to the upper end of the belly of the mandrel. A male connector projecting up from the bottom of the receptacle is engageable with a female wet connector on the lower end of a monitoring tool lowered into the well with an improved kickover tool attached to a slick wireline. The male connector has its lower end extending through the mandrel wall and connected to an electric conductor which extends to surface readout equipment at the surface. The female wet connector initially contains a non-conductive liquid which is displaced upon mating of the connectors in order to flush away and displace conductive substances from the male connector.

U.S. Pat. No. 4,757,859 also issued to Mark A. Schnatzmeyer on Jul. 19, 1988 and is a continuation-in-part of his patent application (Ser. No. 653,585) which matured into his Pat. No. 4,624,309 just discussed. Additionally, this Pat. No. 4,757,859 discloses an improvement in the female wet connector in that it is provided with reserve capacity for the non-conductive liquid. A floating piston separates the top of the non-conductive liquid from well fluids to which the upper side of the piston is exposed. Thus, although a certain amount of non-conductive liquid is lost upon mating of the connectors, enough non-conductive liquid can be carried for several connection operations.

U.S. Pat. No. 4,442,893 issued on Apr. 17, 1984 to Tommy C. Foust for an improved kickover tool for installing devices in and removing them from side pocket mandrels. The kickover tools disclosed in Pat. Nos. 4,624,309 and 4,757,859 of Mark A. Schnatzmeyer (supra) are improvements over that disclosed in this earlier patent of Tommy C. Foust. Each of the prior patents cited above is hereby incorporated into this application for all purposes, by reference thereto.

U.S. Pat. No. 4,583,592 issued to Imre I. Gazda on Apr. 22, 1986. This patent teaches use of a zig-zag slot/- pin arrangement much like the pin/slot arrangement disclosed in the present application. Gazda's zig-zag slot 354 is shown in FIG. 8 of his patent and the pin 350 is shown to be carried on a floating ring 348 in FIG. 2B. The floating of ring 348 is necessary since the zig-zag slot 354 is formed on lower housing section 206 which, due to substantial preload on compression spring 220, would rotate only with great difficulty because of the great friction which would develop at the ends of the spring and at the o-rings.

There was not found in the known art a wet connector for releasably locking the lower end of an electrical cable to a remote electrically powered device for transmitting electrical power or signals therebetween.

The present invention is an improvement over the known wet connectors for running on an electric cable in that it enables mating of male and female connectors in a hostile environment, such as downhole in a well which may contain salt water and/or other conductive substances, and also to latch them together to permit tensioning of the electric cable and yet are readily releasable for ready withdrawal to the surface. The present invention is also directed to systems utilizing wet connectors for connecting an electric cable to remotely located electrically operated tools, such as downhole well tools, and wherein such wet connectors are releasably latched or locked in place.

SUMMARY OF THE INVENTION

The present invention is directed toward wet connectors for releasably connecting an electric cable to a remote electrically powered tool for transmitting electrical energy or signals to or from the same, the wet connectors comprising female and male members which can be locked together, yet can be readily disconnected. The present invention also is directed toward systems for and methods of conducting electrical energy or signals to or from electrically powered devices at remote locations in a well.

It is therefore one object of this invention to provide an improved wet connector which can be lowered into a well on an electric cable and latched or locked onto a mating member carried on the upper end of a tool which includes a device or devices which are electrically operated so that electric power or signals can be transmitted therebetween.

Another object is to provide an improved wet connector of the character described which permits the cable to be slacked or tensioned as needed during the time that electrical power or signals are being transmitted thereacross.

Another object is to provide such a wet connector in which the locking means is electrically operated.

Another object is to provide a system of the character described wherein the latching together and unlatching of the wet connector male and female components is accomplished by applying the electric power in a reverse polarity mode.

Another object is to provide such a wet connector in which the locking means is mechanical and is operated in response to tensioning and slacking the electric cable.

Another object is to provide a system of the character described wherein the latching together and the unlatching of the male and female components of the wet connector is accomplished by slacking and tensioning of the electric cable.

Another object is to provide methods of installing objects in wells by lowering them into position on an electric cable with an electric running tool and releasing them by application of electrical energy.

Another object is to provide a similar method for lowering an electric running tool into a well on an electric cable, engaging an object to be lifted out of the well, latching the running tool to the object through application of electrical energy to the running tool, and lifting the object from the well.

Other objects and advantages may become apparent from reading of the description which follows and from studying the accompanying drawing, wherein:

DESCRIPTION OF THE DRAWING

FIG. 2 is a longitudinal view, partly in elevation and partly in section, showing the male portion of the wet connector shown in FIGS. 1A and 1B;

FIG. 3 is a development view showing a zig-zag slot of the type shown formed in the exterior surface of the male connector of FIG. 2;

DESCRIPTION OF THE PREFERRED EMBODIMENTS

Figure 1A:
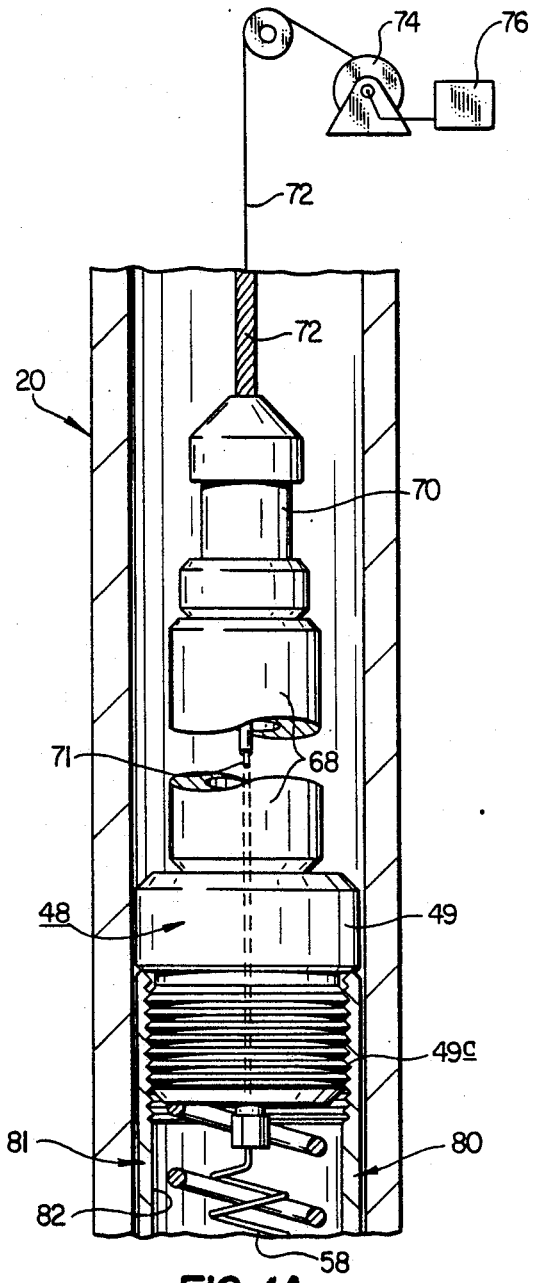
FIGS. 1A and 1B taken together constitute a fragmentary schematical illustration showing a wet connector embodying the present invention connecting the lower end of an electrical cable to the upper end of a well tool locked in the well flow conductor at a downhole location.
Figure 1B:
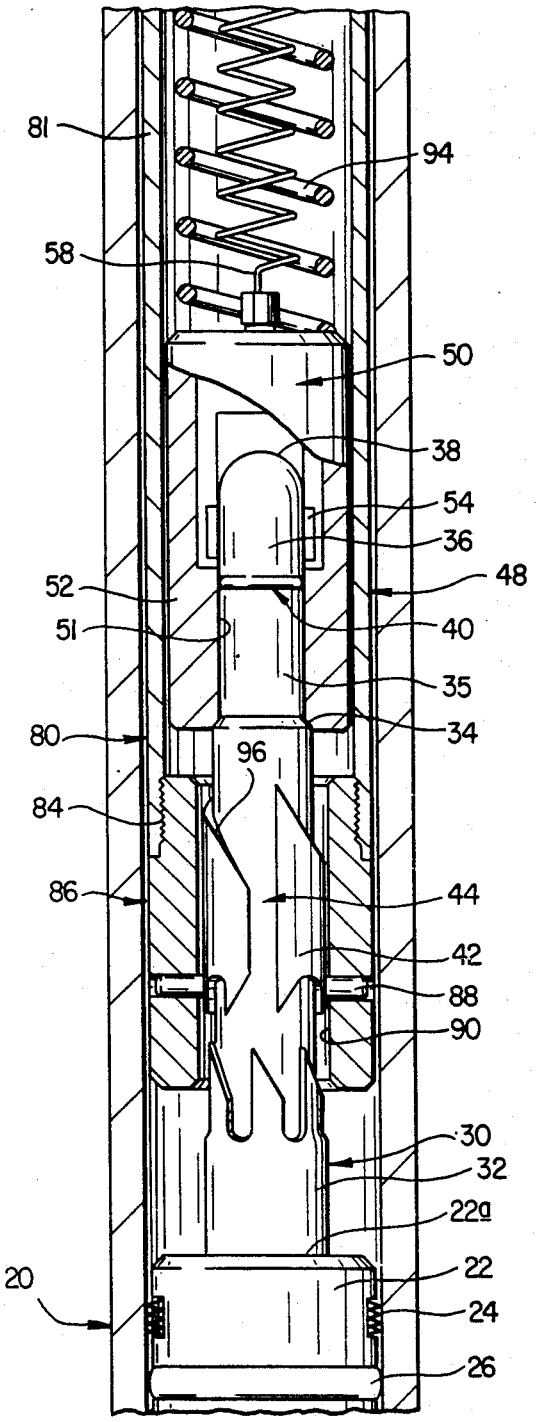

Referring now to FIGS. 1A–1B, it will be seen that a well flow conductor is indicated by the reference numeral 20. This well flow conductor could be a well tubing, drill stem, casing, or other similar flow conductor, for instance.

A well tool 22 is installed in flow conductor 20 at a downhole location in a well (not shown) where it is locked in place by slips 24 while seal means 26 seals between the well tool 22 and the flow conductor 20. Well tool 22 could be any suitable tool powered by electrically, or could be connected to an electrically powered tool.

Well tool 22 is provided with a male connector 30 suitably attached thereto, and projecting upwardly therefrom, as shown. The male connector 30 is provided with a body 32 having an upwardly facing external annular shoulder 34 below its upper end provided by a reduction in diameter as at 35. An electrical contact 36 is seen above the body 32 and its upper end is well rounded as at 38, but could be formed differently and still provide a good guide surface.

The electrical contact 36 has a small-diameter portion (not shown) which extends downwardly through the body 32 to connect with a portion of the electrical circuitry (not shown) within, the well tool 22 or suitably connected thereto. The male connector is shown in greater detail in FIGS. 2 and 3 and will be explained later.

An insulator 40 separates the contact 36 from the body 32 in a manner which will be described later.

The male connector body 32 is enlarged as at 42 below upwardly facing shoulder 34 and a zig-zag slot 44 is formed in its outer surface to provide latch means for releasably connecting the female wet connector to the male connector as will be explained. The zig-zag slot is better seen in the development view of FIG. 3 and will be described later.

A female wet connector 48 includes a female receptacle member 50 having a body 52 slidably carried therein and which has the open lower end of its bore 51 telescoped over the upper end of the male connector 30, and downward movement thereof relative to the male connector has been limited by upwardly facing shoulder 34, as shown. In this position, the electrical contact 36 of the male connector is engaged by the electrical contact 54 of the female connector. Electrical contact 54 is electrically connected by suitable means (not shown) to insulated electrical conductor wire means 58 which has its lower end connected to the upper end of female receptacle body 52. Wire means 58 extends through the closed upper end of the female connector 48 and its upper end is connected to the lower end of an extension 71 of electrical cable 72 which passes through tool string 68 and rope socket 70. Electrical cable 72 extends to the surface where its upper portion is wound upon reel 74 and its upper end is electrically connected to surface equipment 76 which may include a source of electrical power, means for sending and receiving electrical power and/or signals to and/or from the well tool 22, means for processing such signals, and means for displaying and recording resultant data. The use of surface readout equipment in conjuction with an electric cable and previously installed downhole electrically powered devices such as gauges and transducers is taught in Pat. No. 4,510,797 to Guidry, et al., and also in Pat. No. 4,553,428 to Upchurch and some others.

The surface equipment may be capable of performing several additional functions such as unloading electronic memory means, re-programming electronic devices such as semiconductor chips or the like, and/or recharging batteries used in the downhole electrically powered tool.

Female wet connector 48 includes upper sub 49 attached as by thread 49*a* to the upper end of tubular barrel 81 having a bore 82 and attached thereto as by thread 84 to lower sub 86 as shown.

Lower sub 86 carries latch means in the form of latch lugs or latch pins 88 which projectly radially inwardly into bore 90 of the lower sub. These lugs or pins 90 are engageable with zig-zag slot means 44 of male connector 30 and are effective in releasably connecting the female wet connector 48 to the male connector 30 as will be explained later.

After the female receptacle member 50 is shouldered up against upwardly facing shoulder 34 of the male connector body 32, the housing 80 is moved farther downwardly and can be reciprocated without lifting the female receptacle member away from shoulder 34 in order to cause latch pins 90 to follow the zig-zag slot 44 to effect disconnect in a manner later to be described.

In order to avoid wear and tear on the mating electrical contacts 36 and 54, a coil spring 94 is placed as shown in barrel 81 with its lower end supported upon the upper end of body 51 of the female receptacle 50 while its upper end bears upwardly against the lower end of upper sub 49. The spring 94 will understandably hold the female receptacle in firm contact with upwardly facing shoulder 34 as shown, while the housing 80 is reciprocated to operate the zig-zag slot and pin mechanism.

Because of this relative movement between the female receptacle and the housing 81, the conductor wire 58 is preferably coiled to resemble a helical spring, as shown, so that it will not be subject to tensile loads as a result of the relative longitudinal movement just explained.

In operation of the system shown in FIGS. 1A–1B, the device 22, having the male connector 30 at its upper end, is installed in the well flow conductor 20 first. Then the female wet connector 48 is lowered into the flow conductor with tool string 68, including rope socket 70, on the electric cable 72. Cable 72 is a conventional electric cable for use in wells, and the like, and although not shown, comprises a central insulated conductor wire surrounded by two layers of armor wires. The central conductor wire transmits electrical current in one direction and the current returns through the armor wires. Of course, in reverse polarity, the current flows first down the armor wires to return through the central conductor wire. When the female wet connector 48 arrives at the well tool 22, it telescopes over the male connector 30. As it does so, latch pins 88 are guided by inclined guide surfaces 96 into the zig-zag slot means 44. The female connector is stopped by upwardly facing shoulder 34 on the male connector, but the female connector housing 80 continues downward under the weight of the tool string 68. The latch pins 88 will thereafter reach the lowermost portion of the zig-zag slot and stop further descent of female wet connector. It may be desirable to locate the slot and pins so that the lower end of the female connector comes to rest upon upwardly facing shoulder 22*a* of well tool 22. The tool string 68 may then be lifted. If so, female connector housing 80 moves up until latch pins 88 reach a downwardly facing pocket of the zig-zag slot means and can not move upward any farther. The wet connector 30,48 is now as seen in FIGS. 1A–1B. The female connector housing 80 is as high as it can be lifted and female receptacle 50 remains at its lowest position relative to the male connector. The electrical contacts 36,54 are in contact with each other and are ready to transmit power or signals between the cable and the well tool while the electric cable preferably remains tensioned, but could, if desired, be slacked.

When it is desired to retrieve the female wet connector 48, the electric cable is slackened and tensioned a number of times to cause the latch pins 88 to advance along the zig-zag path of slot 44 until they come to a long open slot. At this time the female wet connector will be lifted free of the male connector as the pins are free to travel upward through the open vertical slots.

The first form of the male connector is shown in FIG. 2 where it is indicated by the reference numeral 100.

Male connector 100 has a body 102 reduced in diameter and threaded as at 104 for attachment to a well tool, or the like. A seal ring 106 is disposed in a suitable recess to seal the connection.

Body 102 is reduced in diameter as at 108 providing a surface in which the zig-zag slot means 110 is formed. Body 102 is further reduced in diameter as at 114 above the zig-zag slot means 110 providing an upwardly facing inclined stop shoulder 116.

Body 102 has a bore 120 which is enlarged and threaded as at 122 at its lower end for attachment of connector assembly 124 from which an electrical conductor 125 extends downwardly, and from which another electrical conductor 126 extends upwardly through bore 120 to the male contact 130 as shown. The upper portion of bore 102 is enlarged as at 132 and threaded as at 134 to receive the insulator 136 which is screwed thereinto. The insulator is formed with an external flange 138 which overlies the upper end surface of body 102 as shown.

The male contact 130 has its lower portion reduced in diameter as at 140 and is threaded as at 142 into the insulator 136. Seal ring 144 carried in a suitable recess in the insulator seals between the male contact 130 and the insulator 136 while seal ring 146 carried in a suitable recess in the body 102 seals between the insulator and the body, as shown. The male contact is exposed above flange 138 of the insulator and provides an electrical contact surface 148 which will be engaged by a female contact as will be explained later. The upper end of the male contact is shown rounded to provide a suitable guide surface, but it could be shaped differently, if need be.

The zig-zag slot means 110 seen in FIG. 3 coacts with a latch pin on the female wet connector in such a way that when the female wet connector is telescoped over the male connector 100, as before explained, the connection is made and tensioning of the electric cable will not separate the male and female members. However, after the electrical cable has been tensioned and slackened a predetermined plurality of times, the male and female members pull apart readily.

Referring to FIG. 3, the entire zig-zag slot is shown in that the full 360-degrees of it is rolled out in this development view. As the female wet connector is telescoped over the male connector, one of the latch pins, represented here by the reference numeral 160, enters the zig-zag slot means 110 and its path is shown by dotted lines.

The pin 160 moves downwardly, engages the inclined guide surface 162 of the slot means 110, is guided into narrow vertical slot 164, moves down to upwardly facing cam surface 165 and is guided thereby into upwardly facing pocket 166 to stop the descent of the female wet connector relative to the male connector.

When the cable is tensioned and the female wet connector housing moves up, the pin 160 will move up, will encounter downwardly facing cam surface 167, and will be guided thereby into downwardly facing pocket 168 to stop upward travel of the female wet connector and prevent breaking of the electrical connection.

Slacking and tensioning of the electric cable in such manner results in the latch pin 160 progressing along the zig-zag slot until it is finally lifted and is guided by cam surface 179 into vertical slot 180 which permits the female wet connector to be pulled free of the male connector and can be withdrawn from the well flow conductor by operating the reel 74 on the surface in the common and well-known manner.

Thus, in the form of the zig-zag slot 110 seen in FIG. 3, the female connector is lifted the fourth time to effect release. The first three times the female wet connector is lifted, the latch pin 160 lodges in downwardly facing pockets 168, 172, and 176, but on the fourth lift, the pin enters vertical slot 180 and pulls free to effect a disconnect.

It is readily understood that the zig-zag slot means may be formed with as many pockets as desired, and that the female connector housing may carry any suitable number of latch pins compatible with the number and spacing of the vertical slots provided. The zig-zag slot means 110 of FIG. 3 has three downwardly facing pockets for each vertical slot. Since there are two vertical slots, the female wet connector should carry one but preferably two latch pins. As shown, the female wet connector is provided with two latch pins. Thus, while one latch pin travels down vertical slot 164, the other latch pin travels down vertical slot 180. These two latch pins must travel duplicate paths and emerge from the zig-zag slot means simultaneously.

Figure 4A:
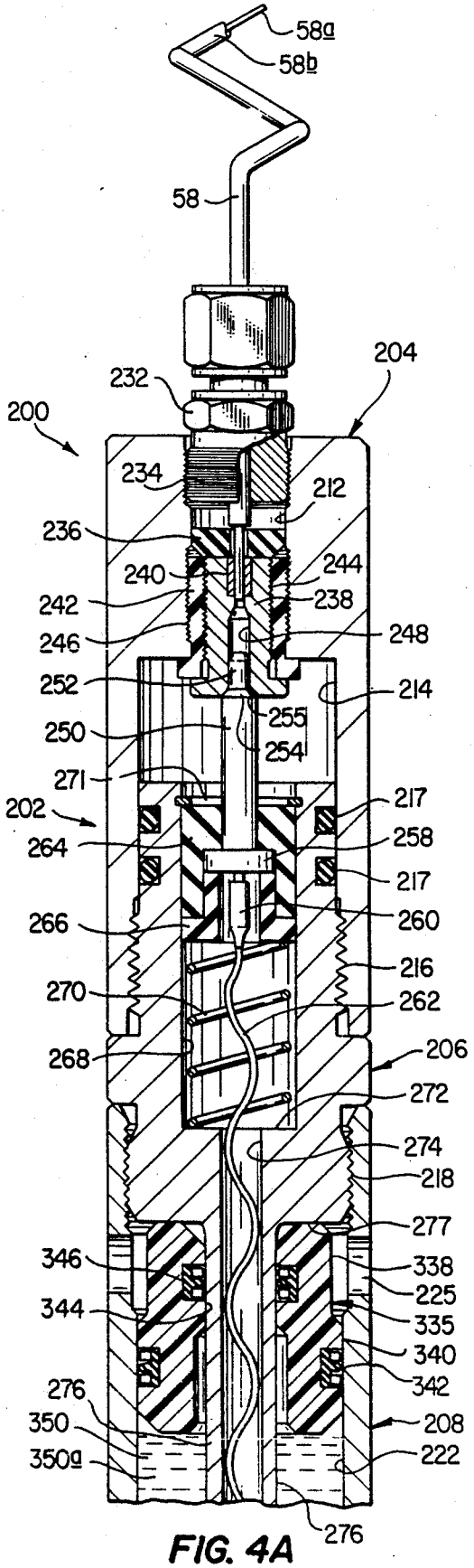
FIGS. 4A and 4B, taken together, constitute a longitudinal sectional view of the female receptacle portion of the wet connector shown in FIGS. 1A and 1B.
Figure 4B:
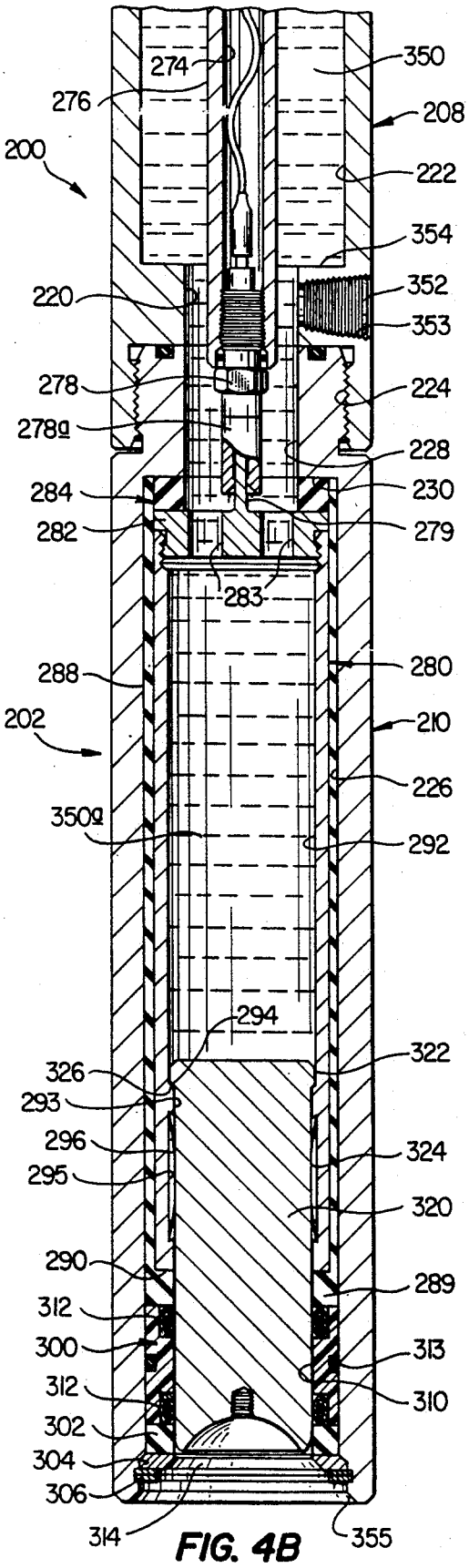

The female electrical receptacle 50 shown schematically in FIG. 1B is seen in detail in FIGS. 4A–4B where it is indicated generally by the reference numeral 200.

The female wet connector 200 includes a body, indicated generally by the reference numeral 202, comprising a cap 204 at its upper end, a threaded connector 206, cylinder 208, and a receptacle body 210.

The cap 204 has a bore 212 which is enlarged as at 214 and internally threaded as at 216 to receive the reduced upper threaded end of threaded connector 206. This connection is sealed by seal rings 217 as shown. The lower end of this connector 206 is reduced and threaded at 218 for attachment of cylinder 208.

Cylinder 208 provides a reservoir for non-conductive cleansing liquid as will be explained later. It has a short, rather small bore 220 which is enlarged as at 222 and is internally threaded as at 218 to receive the lower threaded end of the threaded connector 206. Bore 220 of the cylinder 208 is enlarged and internally threaded as at 224. Cylinder 208 is provided with vent means 225 just below internal thread 218, as seen in FIG. 4A.

The receptacle body 210 is reduced and threaded as at 224 at its upper end for attachment to the lower end of cylinder 208. The receptacle body 210 has a bore 226 which is reduced at its upper end as at 228 providing an internal downwardly facing shoulder 230, as shown.

Electrical conductor wire 58 extends from the upper end of the female electrical receptacle and has its upper end connected through cap 204 at the upper end of the female wet connector which is connectable to a conductor extension leading from the lower end of the electrical cable 72 (FIG. 1). Electrical conductor wire 58 comprises the conductor wire **58*a* and surrounding insulation 58*b*. Preferably wire 58 is armored, although no armor is shown. Electrical conductor wire 58 passes downward through connector 232 which is threaded into the upper end of bore 212 of cap 204 as seen at 234. The lower end of the conductor wire 58*a* passes through insulator 236 and is connected into the upper end of female connector 238 as at 240. Female connector 238 is threaded into surrounding insulator 242 as at 244 which, in turn, is threaded as at 246 into the small threaded bore 212 of cap 204. Female connector 238 has a downwardly opening bore 248 providing a female electrical contact in which the upper end of male contact 250 is received. Thus, the conductor wire 58 and female connector 238 are insulated from the cap 204 by insulators 236 and 242** as shown.

Male contact 250 has its reduced upper end portion 252 engaged in the downwardly opening bore 248 of female connector 238 and has its upwardly facing inclined annular shoulder 254 in firm contact with the a corresponding chamber 255 of the female connector 238 as shown.

Male contact 250 is formed with an external flange 258 while its extreme lower end is rather small in diameter and is telescoped into connector 260 on the upper end of conductor wire 262 which extends some distance therebelow as soon will be explained.

The flange 258 of the male contact 250 is received in insulation which is formed in two parts. The first is the upper insulator member 264 which surrounds the flange 258 as shown, and the other is the lower insulator member 266 which telescopes into the upper insulator member 264 and has its upper end pressing against the under side of flange 258 to thus capture the flange as shown. The two insulator members 264, 266 are slidable in bore 268 of threaded connector 206. A coil spring 270 has its lower end supported upon upwardly facing shoulder 272 provided by reduced bore 274 while the upper end of the spring 262 applies an upward bias to the male insulator 250 through lower insulator member 266. Retainer ring 271 retains the insulators 264, 266 and therefore male contact 250 in place by limiting their upward movement relative to threaded connector 206. When the cap 204 is unscrewed a short ways, the upper insulator 264 will be moved upward by spring 270 to abut the lower side of retainer ring 271 after which it cannot move farther upwardly.

Bore 274 of the threaded connector extends downwardly through reduced diameter tubular extension 276 formed as a part of threaded connector 206 and which depends therefrom to provide a conduit for conductor wire 262 and to provide a downwardly facing shoulder 277. (Tube 276 could be formed separately and attached to threaded connector 206 by suitable mean, such as, for example, threads, soldering, or the like.)

Conductor wire 262 electrically connects the lower end of male connector 250 to the upper end of connector 278 which is screwed into the lower threaded end of extension 276 of threaded connector 206, as shown. The lower end of connector 278 has a female receptacle **278*a* which receives an upwardly extending contact 279 on the upper side of cap member 282 screwed into the upper end of conductor sleeve 280. Fluid passages 283 are formed in cap member 282** for a purpose to be made known later.

An insulating ring 284 is disposed as shown between the upper side of cap member 282 and the downwardly facing shoulder 230 formed by reducing bore 226 as at 228. In addition, an insulating sleeve 288 surrounds the conductor sleeve 280 and has its upper end surrounding insulator ring 284. The lower end of insulating sleeve 288 extends below the lower end of conductor sleeve 280 below which the insulating sleeve has its wall thickened inwardly to provide an internal flange 289 which covers the lower edge 290 of the conductor sleeve, as shown.

Conductor sleeve 280 has a bore 292 which is decreased in diameter as at 293 providing an upwardly facing shoulder 294 intermediate its ends. Between upwardly facing shoulder 294 and the lower end of the conductor sleeve there is provided wide but shallow internal annular dovetail recess 295. Disposed in recess 295 is a louvered electrical contact band 296 which extends very nearly 360 degrees about bore 293. Suitable louvered electrical contact bands are available from Hugin Industries, Inc., Los Altos, CA.

The lower end of insulator sleeve 288 rests upon the upper end of insulator member 300 which rests upon insulator ring 302 supported upon guide ring 304 which is retained in the position shown by suitable retainer means such as a retainer ring 306.

Guide ring 304 is formed as shown with a downwardly facing internal chamber or guide surface 314 for guiding the upper end of the male connector 100 (FIG. 2) into the female receptacle.

Insulator member 300 is formed with a bore 310 which is enlarged at both its upper and lower ends to provide recesses in each of which is disposed a one-way seal ring 312. An o-ring 313 seals between the insulator 300 and the inner wall of female connector body 210.

A plug 320 closes the lower end of the female receptacle. Plug 320 is formed with an outside diameter 322 which is a slidable fit in the bore 292 of the conductor sleeve 280. The plug is reduced in diameter as at 324 providing an external downwardly facing inclined shoulder 326 which is engageable by corresponding upwardly facing shoulder 294 in the conductor sleeve to support the plug in the position shown and thus prevent it from falling out of the receptacle. The lower end of the plug is made concave to correspond to the upper end of the male connector 100.

One-way seals 312 have sealing contact with the outer surface 324 of the plug. The one-way seals are oriented such that fluids cannot move upwardly past the plug, and therefore exclude well fluids and the like, but fluid from above the plug can flow downwardly therepast. Of course, the seals 312 being springy and having a slight interference fit with the plug, will permit such downward flow therepast only if the differential pressure thereacross exceeds a very low value, such as, for instance, one to ten pounds per square inch (69 kilopascals).

A piston 335 is slidably disposed in smooth bore 222 of cylinder 208 and has an outer surface 338 enlarged as at 340 and this enlarged portion is below the vent 225 when the piston is in its uppermost position with its upper end contacting the downwardly facing shoulder 277 of threaded connector 206. The enlarged portion 340 of the piston carries a suitable seal ring 342 in a suitable external annular recess for preventing leakage of fluids past the piston.

Piston 335 has a central bore 344 which accommodates the extension 276, of threaded connector 206, on which the piston is slidable. The exterior surface of tube 276 should be smooth since the piston is slidable thereon. The piston carries an internal seal 346 in a suitable recess for sealing about the extension 276 to prevent leakage of fluids through the bore 344 of the piston. Thus, the piston seals the annulus 350 between the extension 276 and the inner wall of the cylinder 208.

A body of non-conducting liquid, such as a silicone liquid, indicated generally by the reference numeral **350*a*, substantially fills the void spaces between the piston 335 and the plug 320. Thus, a reservoir of non-conductive liquid is provided. (The use of non-conductive liquid in wet connectors is taught in U.S. Pat. Nos. 3,939,705 and 4,105,279 of Glotin, et al., and in U.S. Pat. No. 4,589,717 to Pottier, et al., as well as in U.S. Pat. Nos. 4,624,309 and 4,757,859 to Schnatzmeyer.) This non-conductive liquid may be injected into the void space in the female receptacle by unscrewing the filler plug 352 from the threaded filler port 353. Then with the piston 335 resting against the internal upwardly facing shoulder 354 immediately above the filler port 353, the plug 320 with its shoulder 326 against shoulder 294 of the conductor sleeve 280, and with the female receptacle held bottom side up, a suitable filler line (not shown) may be attached to the cylinder 208 in place of the plug 352 and the non-conductive liquid injected into the cylinder. As the liquid level rises in the cylinder, any entrained air may rise above the liquid level. As liquid is thus forced into the cylinder, air therein will be displaced upwardly past the one-way seals 312. When the piston has been displaced to its position shown in FIG. 4A and when non-conductive liquid begins to escape past the one-way seals, injection of such liquid is stopped. Of course, injection should in most cases be continued until air bubbles no longer appear in the escaping liquid. The device is then laid on its side with the filler port 353 facing upward. The filler line is removed and the filler plug 352** is then replaced into the filler port and is tightened.

The piston 335 floats upon the non-conductive liquid. The upper side of the piston is exposed to well pressure which is admitted into cylinder 208 through vent 225. This same well pressure acts upon the plug 320 at the bottom of the non-conductive liquid. Pressure of the non-conductive liquid is thus normally substantially equalized with pressure exterior of the wet connector.

To connect the electrical cable 72 (FIG. 1) to an electrically powered well tool having a male connector, such as male connector 100 (FIG. 2) on its upper end, the female wet connector 200 (FIGS. 4A–4B) is attached to the tool string 68 and lowered by the electric cable 72 into the well. When the male connector is encountered, the weight of the tool string is sufficient to force the female wet connector to telescope over the male connector as the tool string is lowered farther. As the female wet connector is thus lowered, the plug 320 remains resting upon the upper end of the male connector. This relative movement of the housing relative to the plug tends to compress the non-conductive liquid which is then forced downward past the one-way seals 312. This downward flow of liquid issuing around the plug progressively flushes the male connector as the female connector is telescoped thereover to wash away and displace conductive substances which would otherwise cause short circuiting if it got beyond the one-way seals and into the contact area. Thus, the clean male contact 130 comes into contact with the clean louvered electrical contact band 296 to provide a good electrical connection.

The female receptacle becomes fully engaged when the internal chamber 314 on guide ring 304 engages the upwardly facing external annular shoulder 116 on the male connector. In this position the electrical contact is properly established.

As the female wet connector is telescoped over the male connector, the latch pins 88 carried by the housing 48 (FIGS. 1A–1B) enters the zig-zag slot means 110 (FIG. 3) and engages the guide surface 162 which guides the pin into vertical slot 164. Further lowering of the tool string causes the pin 88 to engage upwardly facing cam surface 165 which directs it into upwardly facing pocket 166. Here, descent of the device stops. When the tool string is lifted and the pin 88 moves upwardly relative to the male connector, the pin engages downwardly facing cam surface 167 and is guided into downwardly facing pocket 168. Now, although the electric cable be held in tension, the female wet connector cannot be lifted off the male connector. With the electric cable thus held taut, the electrical connection is ready to transmit electrical power and/or electrical signals thereacross in either direction as needed. Of course, the electrical cable may be relaxed during transmission of power or signals, if desired. Conditions will likely dictate whether to tension the cable or not at this point.

Of course, should the operator not be certain that the connection has been made, the electric cable can be slackened and the tool train picked up again. This would cause the pin 88 to advance from upper pocket 168 to upper pocket 172, after which operations may be carried out using the devices of this invention.

When it is desired to disconnect the devices, the electric cable is slacked and tensioned again to lower and then lift the electrical wet connector as many times as needed to effect the disconnect so that the female wet connector may be retrieved to the surface. In the pin/-slot arrangement seen in FIG. 3, disconnect occurs on the fourth pick up. This causes the pin 88 to enter upper pockets 168, 172, 176 and vertical slot 180 in succession, as before explained.

It is readily understood that once the latch pin 88 passes through vertical slots 164 and reaches lower pocket 166, the female receptacle 200 cannot again be lifted relative to the male connector 100 until the latch pin advances to the next vertical slot, which is slot 180. As the female wet connector is lowered and lifted to cause the latch pin to thus progress through the zig-zag slot, the female receptacle 100 rests shouldered up on shoulder 116 of the male connector, the coil spring 94 holding it firmly in place as the housing 48 moves up and down relative thereto. Thus, the wear and tear on the male contact surface 148 and on the louvered contact band 296 are minimized, and wastage of the non-conducting liquid is held to a minimum.

It should also be understood that when the connection is made as just explained, a certain amount of non-conducting liquid is lost as the upward movement of the plug 320 relative to the conductor sleeve 280 displaces a portion of such liquid down past the one-way seals to cleanse the male contact as the connection is made. Then, when the female receptacle is lifted from the male connector, the pressure of the non-conductive liquid above the plug 320 is reduced. Accordingly, as the disconnect is made, well pressure above piston 335 being greater than the pressure of the non-conductive liquid therebelow will cause the piston to move downward in the cylinder bore 222 to again completely fill the void in the conductor sleeve 280, but with the piston at a slightly lower location in the cylinder.

Thus, the wet connection can be made again, perhaps several times, if desired. The number of such times will be governed partly by the relative quantity of non-conductive liquid lost each time the connection is made. The length of the cylinder can be made any desired length to provide the desired volume in the reservoir.

It is further understood that while well tool 22 as schematically illustrated in FIG. 1B resembles a well packer, the male wet connector 200 could be attached to other tools such as, for instance, an electronic pressure and/or temperature instrument, even one of the recording type which would include batteries and a central processing unit (CPU).

A second form of female wet connector is seen in FIGS. 5A, 5B, 5C, 6 and 7 where it is indicated generally by the reference numeral 400. Female wet connector 400 is shown engaged with a second form of male connector indicated generally by the reference numeral 500 in FIG. 5C.

Female wet connector 400 is similar to the female wet connector 200 described hereinabove but employs a somewhat different latch means for releasably locking it to its corresponding male connector.

Figure 5A:
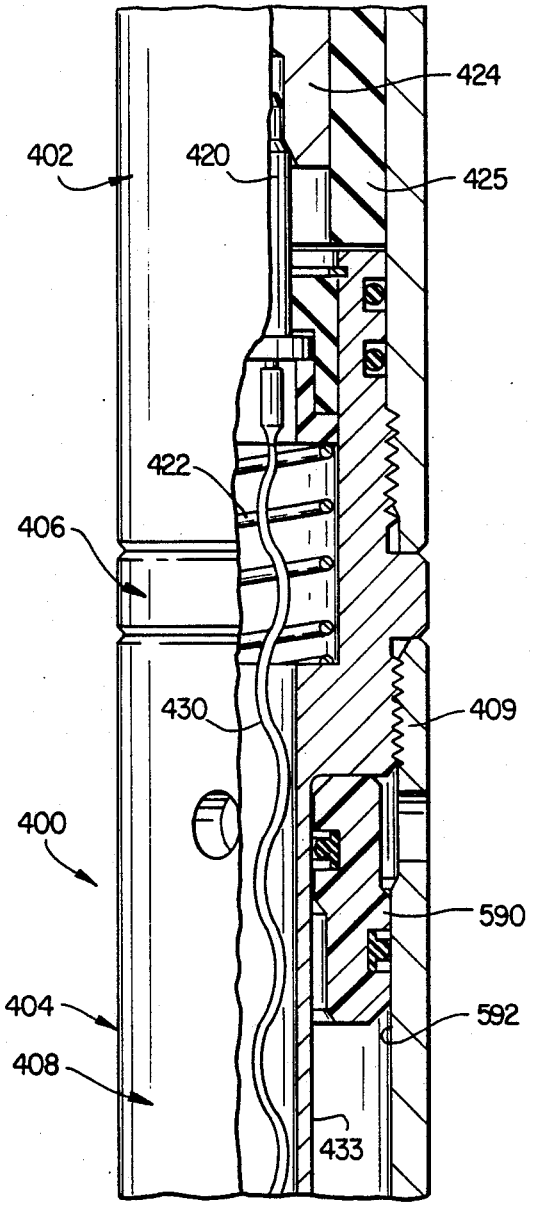
FIGS. 5A, 5B, and 5C, taken together, constitute a fragmentary view, partly in elevation and partly in section with some parts broken away, showing another form of wet connector which embodies the present invention.
Figure 6:
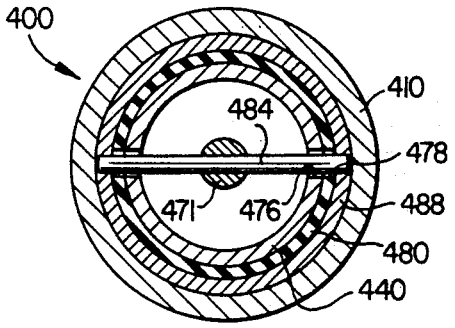
FIG. 6 is a cross-sectional view taken along line 6—6 of FIG. 5B.
Figure 7:
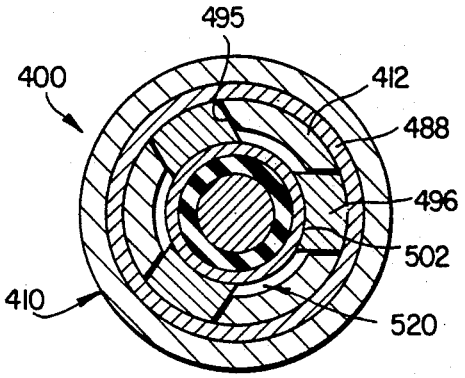
FIG. 7 is a cross-sectional view taken along line 7—7 of FIG. 5C.

Female connector 400 is shown in FIG. 5A with its upper end connected to the lower end of a tool string 402 which is lowerable into a well (not shown) on an electric cable (not shown) but which may be exactly like cable 72 attached to reel 74, and surface readout equipment 76 seen in FIG. 1.

Female wet connector 400 is provided with housing means 404 which includes a threaded connector 406, a cylinder 408 threaded thereto as at 409, a receptacle body 410 having a bore 411, and a bottom sub 412 threadedly attached thereto as at 413. Threaded connector 406 and cylinder 408 may be like the threaded connector 206 and the cylinder 208 of female wet connector 200.

The male contact 420 is seen in FIG. 5A to be pressed upwardly by spring 422 into firm engagement with a mating contact member 424 carried by the tool string 402 and having electrical continuity with the electric cable (not shown) above the tool string. Insulator 425 surrounds contact member 424 within tool string 402.

Insulated wire 430, which has its upper end connected to the lower end of male contact 420, and passes downwardly through spring 422 and threaded connector 406 where its lower end is attached to the upper end of the electrical connector 432 screwed into the lower threaded end of the connector's tubular extension 433, which has a receptacle 433*a* at its lower end in which is engaged the upstanding contact 433*b* extending upwardly from cap member 434. Cap member 434 is very similar to cap member 282 of the previous embodiment in that it is provided with at least one flow passage 438 and is screwed into the upper end of the conductor sleeve 440. An insulator ring 441 is interposed between the upper side of cap member 434 and downwardly facing shoulder 482 of the receptacle body 410 as shown.

Conductor sleeve 440 is formed in upper and lower sections 440*a* and 440*b* which are connected together by suitable means such as thread 440*c*. Upper section 440*a* has an upwardly opening flat bottom bore 442 threaded at its upper end as indicated at 444 to receive the cap member 434. Upper section 440*a* also is formed with a downwardly opening flat bottom receptacle bore 448 which is chambered at its lower end providing downwardly facing stop shoulder 449. Bore 440*d* of lower section 440*b* is slightly reduced as at 450 providing upwardly facing internal annular shoulder 452 which limits downward travel of plug 454. Plug 454 is inserted into the upper end of lower section 440*b* prior to connecting the two sections 440*a* and 440*b* together by making up thread 440*c*. Below upwardly facing shoulder 452, a suitable shallow internal annular slot such as dovetail slot 456 carries a louvered electrical contact band 460 for making electrical contact with the male connector 500 when the female receptacle is telescoped over its upstanding contact member, as will be seen.

Between the upwardly opening bore 442 and the downwardly opening bore 448 of upper section 440*a*, a wall or partition 462 is formed. This partition is provided with at least one offset fluid passage 464 and is also provided with a central opening threaded as at 468 for attaching an electric actuator 470 whose function will soon be made clear. This electric actuator is supplied electric power and/or signals by way of electrical cord 472 connected at its upper end to cap member 434 and at its lower end to actuator 470, as shown. Ground wire 473 grounds the actuator to the housing 404, being secured thereto by screw 474 screwed into the upper end of receptacle body 410 in the counterbore 410*a* provided. Ground wire 473 is similarly secured to actuator 470 by screw 474*a*. Ground wire 473 permits operation of the electric actuator at any time, even when the female wet connector is not engaged with the male connector and without transmitting any power or signals through the wet connector per se. Normally, electrical current flows down through the conductor wire of the electric cable and then up through its armor wires. The actuator 470 requires considerably more electrical power than do most of the well tools or instruments connected below the male connector. Such great electrical power could do great damage to such tools, or transducers, or instruments. Therefore, a diode (not shown) is used in the actuator circuitry to protect such tools and instruments when this greater power is transmitted to the actuator while reverse polarity is being used, the power being transmitted down the armor wires and up the conductor wire. It is now readily understandable that the wet connector cannot be unlatched inadvertently since the power used to operate the downhole tool to which it is latched must be transmitted in the normal (or non-reverse mode) and this low power is insufficient to operator the actuator.

Conductor sleeve 440 is provided with vertically extending slots 476 which align with vertical slots 478 of similar size formed in the wall of insulating sleeve 480 which surrounds the conductor sleeve 440 and extends upward to the downwardly facing shoulder 482 in receptacle body 410, as shown.

The female wet connector is provided near its lower end with an annular insulator member 506 surrounding the male connector 500 and resting atop bottom sub 412. This insulator member has an external annular recess about its mid-section in which a seal ring such as o-ring 508 seals between it and the inner wall of the lock sleeve 488. The insulator member is also provided with an internal recess at its upper and lower ends in each of which is disposed a one-way seal 510 whose inner lip initially engages the outer surface of the male connector to prevent fluid flow upwardly therepast, but will allow fluid flow downwardly therepast in exactly the same manner as did the one-way seals 312 of the female wet connector 200.

The electric actuator 470 has a shaft 471 extending from its lower end which can move longitudinally as the actuator is energized and de-energized. This shaft has a cross-pin 484 mounted in a traverse hole 486 in the shaft and having its ends extending outwardly therefrom (see also FIG. 6). Cross-pin 484 extends through aligned vertical slots 476 and 478 of the conductor sleeve and the insulator sleeve and has its ends received in suitable lateral holes in lock sleeve 488 which surrounds the insulator sleeve 480. Thus, when the cross-pin 484 is lifted by the shaft 471 of the actuator, it will lift the lock sleeve 488. This it does against the downward force of coil spring 490 which has its upper end bearing against downwardly facing shoulder 492 of the receptacle body 410 while its lower end bears downwardly upon the upper end of lock sleeve 488 for a purpose to be described.

The actuator is controllable from the surface. It can include either a suitable solenoid or a suitable electric motor. If it includes a solenoid, it would lift the cross pin 484 and lock sleeve 488 when energized, and upon being de-energized the spring 490 would force the lock sleeve back to its lowermost position, shown. If, however, the actuator is an electric motor, it could lift the lock sleeve against the compression of spring 490 when powered but upon loss of power a clutch (not shown) or similar device could slip or ratchet to allow spring 490 to force the lock sleeve back to its lower position.

The lock sleeve 488 is a sliding fit in the bore 411 and also a sliding fit about insulator sleeve 480 as well as about the upper reduced portion 494 of bottom sub 412.

The upper reduced portion 494 of bottom sub 412 is provided with lateral windows 495 in each of which a latch lug 496 is disposed for radial movement between an inner locking position (shown) (see also FIG. 7) and an outer released or unlocking position (not shown). When the lock sleeve 488 is up, the latch lugs 496 are uncovered thereby and are free to move radially outward to clear the bore 497 of the bottom sub; and when the lock sleeve moves down, as shown, the latch lugs are cammed inwardly by cam surface 498 of the lock sleeve to their inner latching position wherein they are confined, as shown, and project into bore 497 of the bottom sub as clearly seen in FIG. 7. Thus, the lugs are lockable in their inner position by the lock sleeve when it is down and supports them against outward movement.

When the female wet connector 400 is telescoped over the male connector 500, the lock sleeve 488 must be held up to allow latching lugs 496 to retract in order to move down over the male connector. It is lowered until it reaches the position shown in FIGS. 5B and 5C. In this position, the upper end of plug 454 engages the lower end 449 of upper section of 440*a* of conductor sleeve 440. The lock sleeve is then allowed to move down and apply an inward camming force to each of the latch lugs to cam them inward into engagement with external annular latch recess 502 and lock them in there to firmly connect the male and female connectors with one another, as shown. They cannot be pulled apart until the lock sleeve 488 is lifted to unconfine or release the latch lugs 496 for outward movement to disengage the annular latch recess 502.

The space shown between shoulder 501 and the lower end of bottom sub 412 is to allow for solid particles or the like which may settle on the male connector 500 and possibly prevent a successful latch-on.

The male connector 500 is very similar to male connector 100 of FIG. 2 and comprises a body 520 having a bore 522 enlarged as at 524 providing a downwardly facing shoulder 526. Enlarged bore 524 carries an electrical connector which includes a male contact 528 slidable in insulator barrel 530 retained by suitable retainer means such as retainer ring 532. A spring 534 applies a downward bias to male contact 528 to hold it in firm contact with conductor member 536 surrounded by insulating member 538 carried in the bore 600 of electrically powered well tool 602 to which the male connector 500 is attached as by threads at 606, this connection being sealed by seal rings 608.

The electrically powered well tool 602 may include a recording electronic pressure and/or temperature instrument having a central processing unit (CPU) and batteries.

The male connector 500 has an insulating sleeve 542 secured in bore 522 of male connector body 520 as by threads 520*a* and has an external flange 544 at its upper end which overhangs the upper end face of body 520.

The male connector has a main male contact 550 having a head 552 providing a cylindrical contact area and a substantially hemispherical upper end. The male contact has its lower portion reduced at 554 and is disposed within the insulator sleeve 542 where it is held as by thread 556 near its lower end. Below thread 556 the male contact 550 carries a seal ring, such as seal ring 558 in a suitable external recess for sealing with the inner wall of insulator sleeve 542 to prevent fluid leakage therebetween.

The extreme lower end of the male contact 550 is in contact with coil spring 534 as shown. If desired a suitable guide pin such as guide pin 562 can be formed on the lower end of the male contact to hold the upper end of the spring in proper centralized position. Spring 534 transmits electrical current between the male contact 550 above and the male contact 528 below.

Plug 454 is formed with a concave lower end face as at 570 which may conform to the upper end of male contact 550 and has an enlargement 575 at its upper end providing a downwardly facing shoulder 580 which is engageable with corresponding upwardly facing shoulder 452 of the conductor sleeve 440.

The female wet connector 400 is further provided with a piston 590 slidably disposed in cylinder bore 592 which serves the same purpose as does the piston 335 in the female wet connector 200 of FIGS. 4A–4B.

Figure 5B:
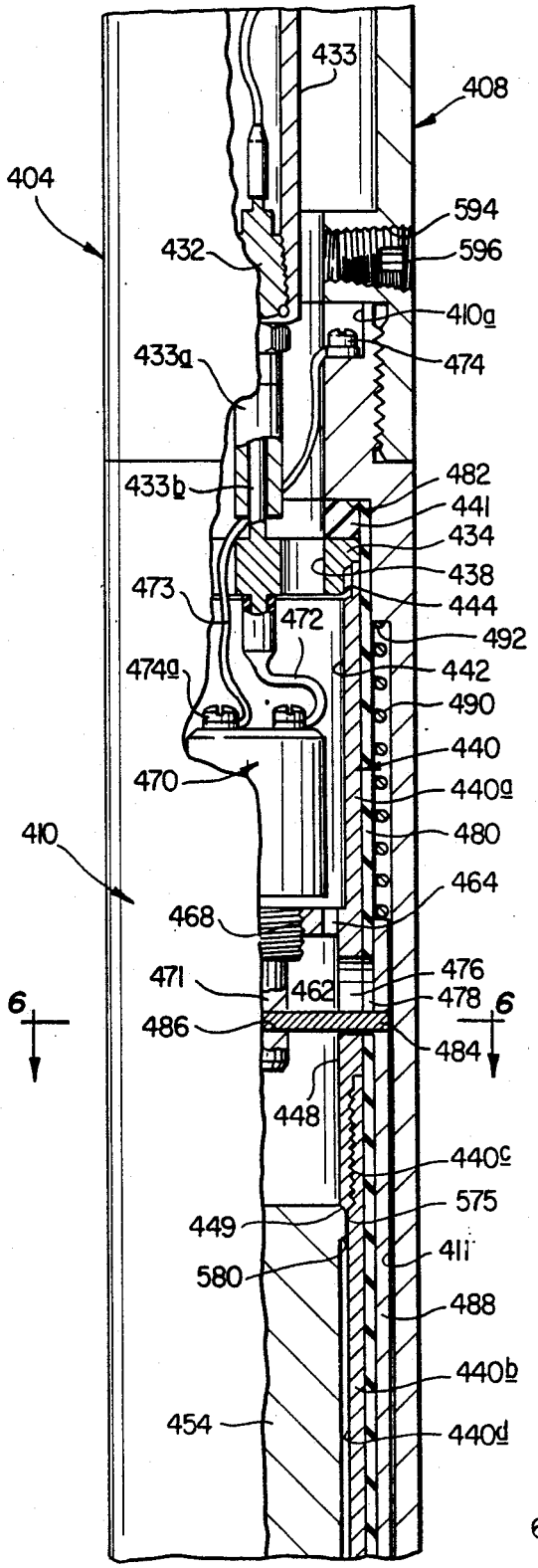

When the female wet connector 400 is ready to be lowered into the well the piston 590 is in its uppermost position, seen in FIG. 5A, the plug 454 is in its lowermost position (not shown) wherein its downwardly facing shoulder 580 rests upon corresponding shoulder 452 in the conductor sleeve 440, the lower portion of the plug is sealingly engaged with the one-way seals 510, and the voids between the piston and the plug are filled with a body of non-conductive liquid (not shown) which was transferred thereinto, in the previously described manner, through filler port 594, shown in FIG. 5B to be closed by filler plug 596.

The female wet connector 400 is lowered into the well as before described. As the vicinity of the well tool is approached the electrical power is applied in a reverse polarity direction, that is, the current is transmitted down through the cable armor and up through the single conductor. The power transmitted should be adequate for operating the actuator 470. As the actuator is energized, the shaft 471 thereof lifts the lock sleeve 488 to free the latch lugs 496 for outward movement to their unlocked position.

As the female wet connector 400 encounters and telescopes over the male connector 500, the plug 550 is moved toward the piston 590, and as it does, a certain quantity of the non-conductive liquid is displaced downward past the one-way seals 510 to flush and cleanse the male connector of conductive and unwanted materials, salt water, well fluids, dirt, sand, et cetera.

When the female wet connector is fully engaged, the louvered electrical contact band 456 thereof will be firmly engaged about the main male contact 550 and the latch lugs 496 will be at the level of the external latch recess 502. The descent of the female wet connector, as stated before, is stopped by its plug 454 coming to rest against downwardly facing shoulder 449 in upper section 440*a* of the conductor sleeve 440.

Figure 5C:
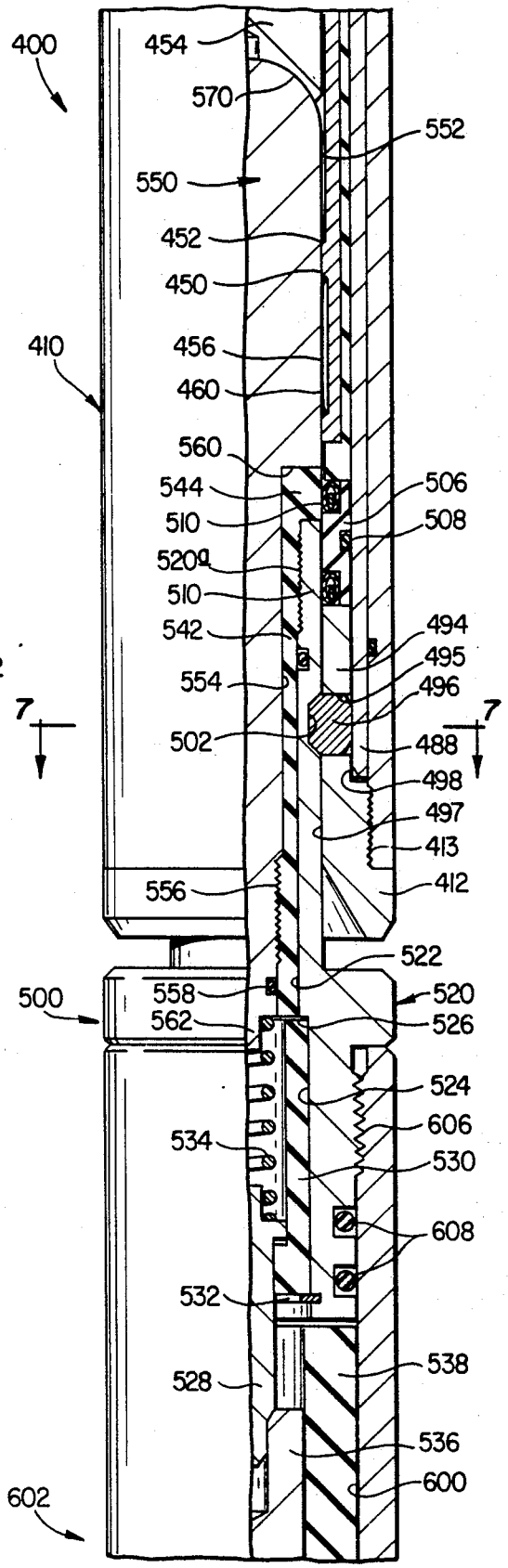

At this time, the power is turned off to de-energize the actuator 470 and allow the lock sleeve 488 to be moved by spring 490 to its lower position seen in FIG. 5C, in which position the latch lugs are engaged in recess 502 of the male connector 500 and are securely locked in place. The female wet connector is thus latched onto the male connector and cannot move up or down. Thus tensioning and relaxing of the cable will not move the mated electric contacts relative to each other and thus, will not unduly wear them, as was explained earlier. The female connector 400 can be pulled free of the male connector 500 only by first lifting lock sleeve 488 and afterwards lifting the female connector, as explained earlier.

After the female wet connector is positively latched onto the male connector, the electric cable is tensioned (of course it could be relaxed) and electrical power and/or signals may then be transmitted between the surface equipment and the electrically powered well tool connected beneath the male connector.

To disconnect the female wet connector from the male connector, the cable is slacked and power is applied in a reverse-polarity mode to energize the actuator to apply a lifting force to the locking sleeve. The lock sleeve will move upward to release the latch lugs, whereupon they move outward. The actuator is kept energized until the female wet connector has been lifted off the male connector by tensioning the electric cable. The female wet connector then may be lifted to the surface. As the female wet connector is lifted relative to the male connector, a differential pressure is created across the plug causing it to move downward in the conductor sleeve 440 as the male connector is withdrawn. As the plug follows the male connector, the pressure of the non-conductive liquid is reduced and the well pressure acting on the upper side of the piston forces the piston down in the cylinder.

After the disconnect is thus completed, the power is turned off. Now, the piston will be somewhat lower in the cylinder than it was when in its initial position seen in FIG. 5A, because a quantity of the non-conductive liquid was lost in flushing the male connector during the making of the previous connection.

If desired, the connection can be re-established as before by using the procedure before stated. The number of times that the connection can be broken and re-established partially depends upon the quantity of non-conductive liquid carried in the reservoir, since a certain quantity thereof is lost with each making of the connection.

The female wet connector 400 shown in FIGS. 5A, 5B, 5C, 6, and 7 can be used also to run a well tool into a well on an electric cable where it may be desirable to disconnect the electric cable from the well tool and withdraw it from the well, leaving the well tool supported in the well, as lodged on an upwardly facing shoulder, or the like.

The female wet connector 400, in combination with the male connector 500, is particularly useful for running a test tool apparatus in the well, installing the test tool apparatus in a suitable receptacle, disconnecting the female connector from the male connector, and retrieving the electric cable and female connector from the well and leaving the test apparatus in the well for continued testing, the test tool apparatus including a well test tool per se and battery powered recording instrument for recording test data. Well test tools of the types illustrated and described in U.S. Pat. No. 4,149,593 to Imre I. Gazda, et al.; U.S. Pat. No. 4,487,261 to Imre I. Gazda; and U.S. Pat. No. 4,583,592 to Imre I. Gazda and Phillip S. Sizer may be used in the manner and methods just described.

All the while that the electric cable is connected to the test tool, data may be transmitted to the surface in the form of electrical signals where it is receivable by surface readout equipment (SRO) which can process such electrical signals and display and or record the corresponding well test data.

If the well test is to continue for an extended period of time, the electric cable may be retrieved from the well after releasing the female wet connector from the male connector. In such case, the recording instrument will continue to record the well test data in its memory. At a later time, maybe hours or days later, the electric cable may be run into the well again and the female connector re-engaged with the male connector. The cable now being electrically connected with the test tool again, surface readout of data is again available. Alternatively, the data stored in the memory of the recording instrument may be quickly transmitted to the surface and stored in the memory of the surface readout equipment (SRO), and/or the batteries of the recording instrument may be recharged by electrical energy transmitted thereto from the surface. After this, the electric cable can be disconnected as before and withdrawn from the well. Then, at the end of the well test period, the electrical cable can be run into the well, re-connected with the test tool in the manner before explained and the test tool pulled from the receptacle and withdrawn from the well.

It is readily understood that the female wet connector together with the male wet connector, as described and illustrated hereinabove may be used simply to emplace certain types of well tools in a well, which well tools have no need of electrical energy, the electrically operated female connector providing for gently releasing such well tool from the electric cable without use of tool or line manipulation, or jarring, but merely by energizing the actuator to release the well tool leaving it supported as on an upwardly facing shoulder, or the like. Similarly, the female connector can be re-engaged with the well tool merely by energizing the actuator of the female connector, setting the female connector down over the male connector of the well tool, and de-energizing the actuator, after which the well tool may be retrieved from the well.

If such non-electrically operated tools are to be placed in wells using the methods just outlined, the male connector can be greatly simplified by omitting the electrical components. For that matter, the receptacle of the female receptacle would have no need of being electrified and its electrical components, too, could be omitted. The electric actuator then being the lowermost item in the electrical circuitry.

Thus, it has been shown that the present invention fulfills all the objects set forth earlier in this application; that the female wet connectors disclosed hereinabove can be lowered into a well or similar shaft, and can be readily latched onto male connector members on the upper end of objects such as, for instance, subsurface or downhole electrically powered tools previously installed therein; that electrical power or signals can be transmitted through the electric cable and coupled connectors to and from the downhole tools; and that the female wet connectors can also be readily unlatched from the male connectors for withdrawal from the well. Also, it has been shown that the electric cable can be either slacked or tensioned at the time that power or signals are transmitted between the female wet connector and the male connector to which it is latched.

Further, it has been shown that the first form of the female wet connector (200) is latched onto the male connector by purely mechanical slackening and tensioning of the electric cable in such manner as to operate the pin/slot arrangement, the slot being termed a zig-zag slot. The second form of female wet connector (400) is latched onto and unlatched from the male connector by energizing and de-energizing an electric actuator which controls the locking and releasing of latch lugs. The electric actuator, as has been shown, is energized by applying the electric power in a reverse polarity mode, a diode being used to protect other downhole tools from the greater electric power required by the actuator.

In addition, it has been shown that the present invention includes not only latching wet connectors, but also systems in which they are used, as well as methods for their use.

The foregoing description and drawing are explanatory and illustrative only and various changes in sizes, shapes, materials, and arrangements of parts, as well as certain details of construction, may be made within the scope of the appended claims without departing from the true spirit of the invention.

We claim:

1. A wet connector device for releasably connecting an electric cable to an electrically powered well tool for transmitting electrical energy or signals to or from the same, said wet connector assembly comprising, in combination:

(A) a male connector comprising:

(a) body means having a longitudinal bore therethrough enlarged at its lower end and provided with means for attachment to said electrically powered tool, said male connector body further including:

(i) electrical contact means for engagement by said electrical contact means of said wet connector, and (ii) latch means below said electrical contact means engageable by said latch means of said wet connector to latch said wet connector to said electrically powered tool; and (b) means for conducting electrical energy or signals from said electrical contact means to said electrically powered tool; and (B) a female connector comprising:

(a) tubular housing means, said housing means having means on its upper end for attachment to said electrical cable and having a bore open at its lower end;

(b) electrical contact means in said housing means and surrounding said housing bore and having means connecting it to said electric cable;

(c) plug means slidably disposed in said housing means and closing said housing bore adjacent said contact means;

(d) a body of non-conducting liquid in said housing bore above said plug means; and (e) latching means carried by said housing means engageable with said latch means on said well tool to releasably latch said housing means to said electrically powered well tool with the electrical contact means of the well tool thereof engaged with the contact means of the connector.

2. The wet connector device of claim 1, wherein when said wet connector engages and telescopes over said electrically powered tool said plug means is moved upwardly relative to said housing means displacing said non-conducting liquid therein downwardly therefrom to displace unwanted fluids and materials from the contact means which are being mated.

3. The wet connector device of claim 2, wherein said housing means is provided with reservoir means for supplying non-conducting liquid as needed for latching and unlatching the wet connector a plurality of times during a single trip, and a floating piston at the upper end of said body of non-conducting liquid has its upper side exposed to pressure exterior of said tubular housing means.

4. The wet connector device of claim 3, wherein means are provided on said wet connector for limiting the telescoping movement of said wet connector relative to said electrical contact means of said electrically powered tool.

5. The wet connector device of claim 1, 2, 3, or 4, wherein said latching means on said housing means is at least one latch member means carried near the lower end of said housing means and projecting into said housing bore, and said latch means on said electrically powered tool is a zig-zag slot means engageable by said latch member means.

6. The wet connector device of claim 5, wherein said body means is formed with an external upwardly facing stop shoulder above said zig-zag slot means but below said electrical contact means for limiting downward telescoping movement of said female wet connector relative to said male connector.

7. The wet connector device of claim 1, 2, 3, or 4, wherein said latch means on said male connector is an annular latch recess below said electrical contact means, and said latching means in said housing means includes:

(a) latching members mounted in said housing means for radial movement between an inner latching position wherein they are engaged in said annular latch recess of said male connector and an outer released position wherein they do not engage said latch recess, (b) a lock sleeve movable longitudinally in said housing means between a releasing position wherein said latching members are released from said latch recess, and a locking position wherein said latch members are locked in engagement with said latch recess by said lock sleeve, (c) means biasing said lock sleeve towards its locking position, and (d) electrically powered means for moving said lock sleeve from its locking position to its releasing position against the force of said biasing means.

8. The wet connector of claim 7 wherein said means for biasing said lock sleeve toward its locking position is a spring, and said electrically powered means for moving said lock sleeve toward its releasing position is a solenoid.

9. The wet connector of claim 7 wherein said means for biasing said lock sleeve toward its locking position is a spring and said electrically powered means for biasing said lock sleeve toward its releasing position is a motor.

10. The wet connector of claim 7, wherein said lock sleeve moves between a lower locking position and an upper releasing position.

11. A system for conducting electrical energy or signals to or from electrically powered means in a well, said system comprising:

(A) an electrical conductor cable having its upper end connectable to electrical apparatus including a source of power at the surface to receive electrical energy or signals therefrom;

(B) a tool string connected to the lower end of said electric cable, said tool string comprising:

(1) weight means, said weight means having a longitudinal passage therethrough and connection means at its upper and lower ends, (2) a rope socket connecting the upper end of said weight means to said electrical cable, and (3) female wet connector means connected below said weight means, said female wet connector comprising:

(a) housing means attached to the lower end of said tool string and having a bore with a lower open end, and internal upwardly facing shoulder means near the lower end of said housing means, (b) a receptacle slidably carried in said bore of said housing means and initially supported on said internal upwardly facing shoulder means, and slidably movable to a higher position therein, said receptacle comprising:

(i) a body having a bore closed at its upper end and having its lower end open, (ii) electrical contact means in said body bore intermediate its ends, (iii) plug means initially closing the lower end of said body bore, and movable to a higher position therein, (iv) non-conducting liquid carried in said body bore above said plug means, and (v) passage means in said body for displacing non-conducting liquid therethrough when said plug is moved upwardly in said body; and (4) electrical conductor means for conducting electrical energy or signals between said electrical cable connected to said rope socket and said electrical contact means in said receptacle bore;

(C) an electrically responsive well tool in said well, said well tool having male connector means on its upper end, said male connector means including:

(1) body means attached to the upper end of said well tool and having upstanding contact means thereon provided with electrical contact surface means intermediate its ends, and (2) an upwardly facing shoulder formed on said body below said electrical contact means of said probe; and (D) coengageable means on said housing means of said female wet connector means and on said male connector means on said well tool for releasably latching said well tool and said female wet connector together when said housing means is telescoped over said male connector means, said coengageable means being releasable to free said housing means from said body means responsive to tensioning and relaxing said electric cable at least one additional time before lifting the said female wet connector means free of said male connector means.

12. The system of claim 11, wherein the electrical apparatus at the surface includes surface readout equipment, and electrical signals generated by said well tool are transmitted therefrom through said wet connector, tool string, and electric cable to said surface equipment for processing, display, printout, and/or storage by said surface readout equipment.

13. The system of claim 11, wherein the well tool is powered by self-contained batteries, and said batteries are charged while said electric cable is connected to said well tool by said wet connector.

14. The system of claim 11, wherein the well tool contains a central processing unit (CPU) and is powered by self-contained batteries, and collects data and stores them in a memory, and said well tool upon being connected to said surface equipment through use of said electric cable and said female wet connector can transmit to the surface the data stored in said memory.

15. The system of claim 11, wherein said well tool includes a central processing unit (CPU) which is reprogrammable from the surface while said electric cable is connected to said well tool by said wet connector.

16. A system for conducting electrical energy or signals to or from electrically powered means in a well, said system comprising:

(A) an electrical conductor cable having its upper end connectable to electrical apparatus including a source of power at the surface to receive electrical energy or signals therefrom;

(B) a tool string connected to the lower end of said electric cable, said tool string comprising:

(1) weight means, said weight means having a longitudinal passage therethrough and connection means at its upper and lower ends, (2) a rope socket connecting the upper end of said weight means to said electrical cable, and (3) electrical conductor means extending the full length of said tool string (C) female wet connector means connected to said tool string, said female wet connector means comprising:

(1) tubular housing means having means on its upper end for attachment to said tool string, and having a bore closed at its upper end and open at its lower end, (2) electrical contact means in said bore of said tubular housing means electrically connected to said electrical conductor means in said tool string, (3) plug means initially closing the lower end of said bore of said tubular housing and movable to a higher position therein, (4) a body of non-conducting liquid carried in said bore of said tubular housing means above said plug, and (5) passage means between said tubular housing means and said plug means for displacing non-conducting liquid therethrough when said plug means is moved upwardly in said bore of said tubular housing means, and (D) an electrically responsive well tool in said well, said well tool having male connector means on its upper end including: body means attached to the upper end of said well tool and having upstanding contact means thereon provided with electrical contact surface means intermediate its ends; and (B) coengageable means on said tubular housing means of said female wet connector means and on said male connector means for releasably latching said female wet connector means to said male connector means when said tubular housing is telescoped over said male connector means, said coengageable means being releasable in response to an electrical signal transmitted thereto from the surface through said electrical conductor cable.

17. The system of claim 16, wherein the electrical apparatus at the surface includes surface readout equipment, and electrical signals generated by said well tool are transmitted therefrom through said wet connector, tool string, and electric cable to said surface equipment for processing, display, printout, and/or storage by said surface readout equipment.

18. The system of claim 16, wherein the well tool is powered by self-contained batteries, and said batteries are charged while said electric cable is connected to said well tool by said wet connector.

19. The system of claim 16, wherein the well tool contains a central processing unit (CPU) and is powered by self-contained batteries, and collects data and stores them in a memory, and said well tool upon being connected to said surface equipment through use of said electric cable and said female wet connector can transmit to the surface the data stored in said memory.

20. The system of claim 16, wherein said well tool includes a central processing unit (CPU) which is reprogrammable from the surface while said electric cable is connected to said well tool by said wet connector.

* * * * *